US006581217B2

(12) United States Patent
Marcos

(10) Patent No.: US 6,581,217 B2
(45) Date of Patent: Jun. 24, 2003

(54) DIRECTIONAL AIR VENTS FOR SPAS AND JETTED BATHTUBS

(76) Inventor: Sam M. Marcos, 701 W. Foothill Blvd., Azusa, CA (US) 91702

( * ) Notice: Subject to any disclaimer, the term of this patent is extended or adjusted under 35 U.S.C. 154(b) by 0 days.

(21) Appl. No.: 10/113,590

(22) Filed: Apr. 3, 2002

(65) Prior Publication Data

US 2003/0019027 A1 Jan. 30, 2003

Related U.S. Application Data

(60) Provisional application No. 60/307,671, filed on Jul. 25, 2001.

(51) Int. Cl.[7] ..... A61H 33/02

(52) U.S. Cl. ..... 4/541.1; 4/541.4; 4/541.5; 4/559; 4/545; 4/546

(58) Field of Search ..... 4/541.4, 541.5, 4/549, 559, 569, 541.1, 545, 546, 524, 525, 533

(56) References Cited

U.S. PATENT DOCUMENTS 541,371 A 6/1895 Marston
4,277,855 A * 7/1981 Poss ..... 4/524
4,858,255 A * 8/1989 Haisman ..... 4/541.4
4,901,379 A * 2/1990 Chalberg et al. ..... 4/541.5
5,386,598 A 2/1995 Mersmann
5,794,280 A * 8/1998 Hansen et al. ..... 4/541.1
6,317,903 B1 * 11/2001 Brunelle et al. ..... 4/541.4

* cited by examiner

*Primary Examiner*—Gregory L. Huson
*Assistant Examiner*—Azy Kokabi
(74) *Attorney, Agent, or Firm*—Edgar W. Averill, Jr.

(57) ABSTRACT

An air-blowing assembly for providing cooling air to the user of a spa, jetted bathtub or other heated water-containing member. The assembly has an air blower with an air blower inlet which received air from outside of the area of the spa. The blower conducts cooling air into a manifold. The manifold directs cooling air out of a series of vents on the upper lip of the spa. The air vents are adjustable in direction so that the user of the spa can direct cooling air to alleviate discomfort from an otherwise hot and moist atmosphere.

8 Claims, 3 Drawing Sheets

DIRECTIONAL AIR VENTS FOR SPAS AND JETTED BATHTUBS

CROSS-REFERENCE TO RELATED APPLICATIONS

Applicant claims the benefit of provisional patent application No. 60/307,671 filed on Jul. 25, 2001.

BACKGROUND OF THE INVENTION

The field of the invention is spas, jetted bathtubs or other heated water-containing members, which will be referred to herein generally as "spas." The invention relates more particularly to spa accessories which are directed to improve the comfort of a user of a spa.

U.S. Pat. No. 541,371 to Marston shows a bath having an outer shell and an inner shell. The outer shell is filled with hot water which is used to control the temperature of the water within the inner shell. A tube 16 introduces fresh air to the bathing or washing compartment. Tube 16 has a cover 17 which is removed to permit the flow of fresh air. While such tube provides fresh air to the room in which the bathtub is contained, it is not designed to direct fresh air toward a user of the tub.

The Mersmann U.S. Pat. No. 5,386,598 shows a motor which draws water in through a slitted cover below the water level. A source of air 15 may be introduced into the water and forced outwardly by the impeller.

Spa water often contains chlorine or ozone as a water purifying agent. Since the spa water is invariably heated, the presence of chlorine or ozone can collect above the surface of the spa water where the user typically inhales such moist and often chlorine or ozone scented vapors. The inhalation of such vapors can decrease the enjoyment of the spa or other heated water-containing member.

BRIEF SUMMARY OF THE INVENTION

It is an object of the present invention to provide an air-blowing assembly which is capable of improving the quality of the air breathed by the user of a spa.

The present invention is for an air-blowing assembly for providing cooling air to the user of a spa, jetted bathtub or other heated water-containing members. Such members have a lip surrounding at least a part of the water-containing member. The assembly includes an air blower having an air blower inlet, an air blower outlet and means for energizing the air blower. An air-conducting manifold has an air inlet connected to the air blower outlet. The manifold has a series of outlets, each outlet being connected to at least one directional vent supported over the lip of the spa. The vent directs cooling air in a direction which may be aimed by the user. In this way, the user can direct air flow through the cooling air outlet to remove hot, humid, and often chlorine or ozone-containing vapors from his area of breathing. Preferably, the directional vent has a plurality of louvers which may be adjusted to further direct the flow of air to the most comfortable position.

DESCRIPTION OF THE PREFERRED EMBODIMENTS

Figure 1:
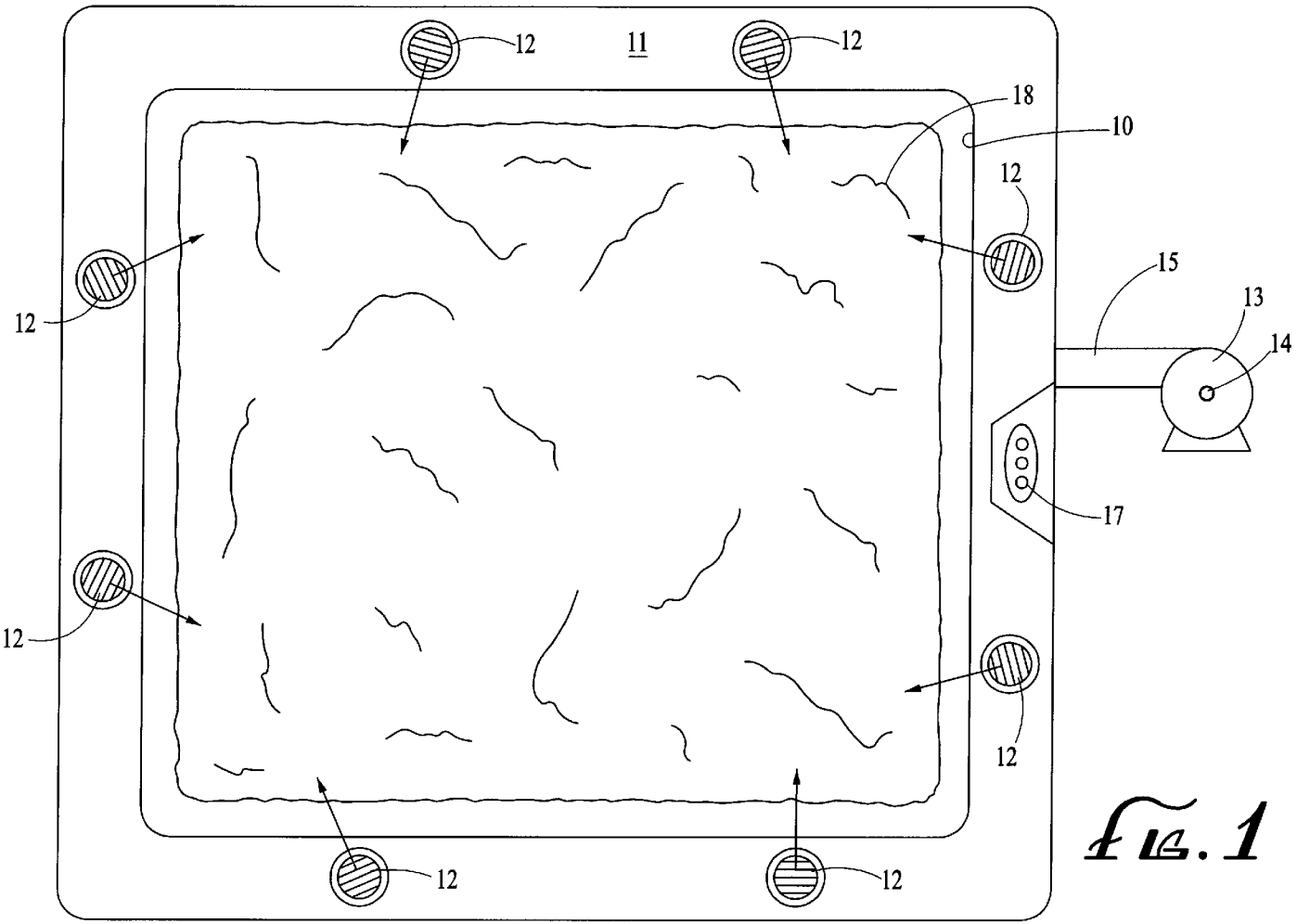
FIG. 1 is a plan view of a spa having a plurality of directional air vents located on an outer lip of the spa.

A spa 10 is shown in FIG. 1 and has a lip 11. Lip 11 has eight louvered directional vents 12, each of which have air outlets which are adjustable to provide a preferred direction of cooling airflow.

An air blower 13 has an air inlet 14 and an air outlet 15. The water 16 in spa 10 is typically heated and this creates an atmosphere of hot, moist air above the surface of the water 16. As stated above, this moist air often contains chlorine, ozone, or other water purifying elements which are normally inhaled by the user of a spa. Such inhalation can decrease the enjoyment of the use of the spa and the present invention is directed toward a system which substantially improves the nature of the inhaled air by the user of a spa.

The term "spa" is used herein in a broad sense and is intended to include jetted bathtubs or other heated water-containing members. Thus, the term "spa" is not intended to limit the use of the present invention to spas, but includes any heated water-containing member designed for use by persons.

Returning to FIG. 1, spa 10 has a control panel which includes at least one button for the turning on and off of air blower 13.

Figure 2:
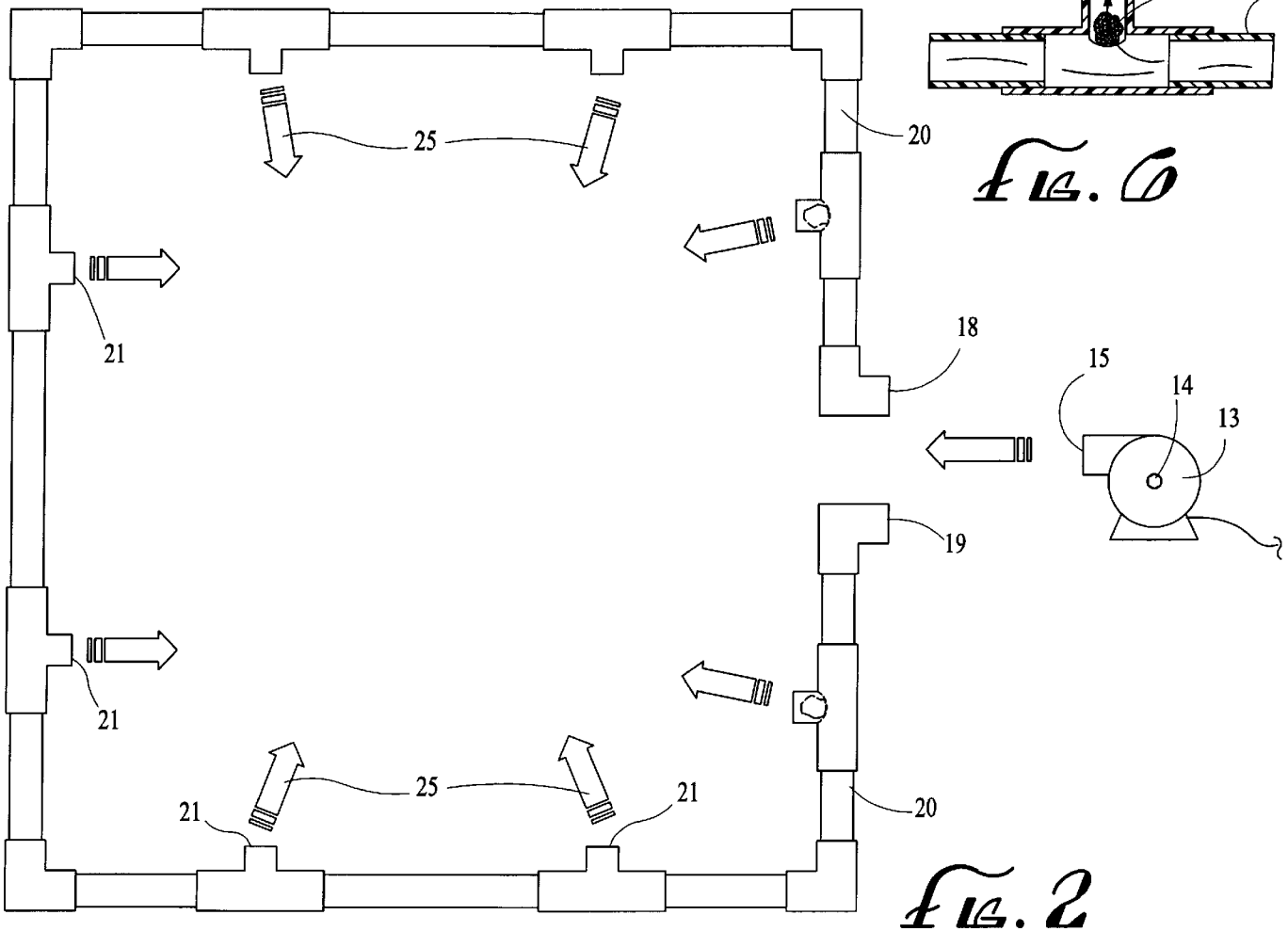
FIG. 2 is a schematic view of an air blower and air-conducting manifold useful in connection with the air-blowing assembly of the present invention.
Figure 5:
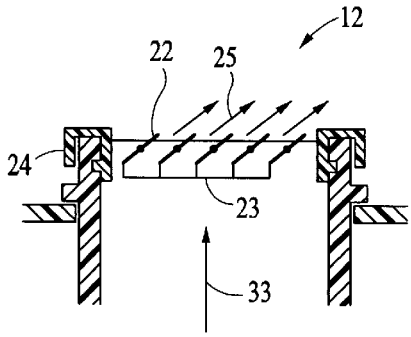
FIG. 5 is a cross-sectional view of an adjustable air outlet vent used with the present invention.

As shown in FIG. 2, air blower 13 has an outlet which feeds a pair of manifold air inlets 18 and 19, which direct cooling air into the air-conducting manifold 20. Air-conducting manifold 20 has a plurality of manifold air outlets 21 which are connected to directional vents which are shown in FIG. 5. Directional vent 12 has a plurality of louvers 22 which may be connected by a link 23 so that the louvers 22 remain parallel. The louvers are preferably held by a collar 24 which permits the turning of the louvers through an arc. The arc may be 360 degrees or just a partial portion of the complete circumference. In this way, the user can turn the vents in any desired direction as well as control the angle from which cooling air 25 exits the directional vent 12.

Figure 6:
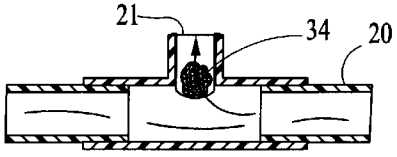
FIG. 6 is a cross-sectional view of a scent-emitting package and the air line of the air vent of the present invention.

FIG. 6 shows a cross-sectional view of an optional feature wherein a scent package 34 is placed in air outlet 21. As air flows through manifold 20 and out of air outlet 21, it passes through scent package 34. This picks up the type of scent added to the package so that the air coming out of the vents has a pleasant fragrance.

Figure 3:
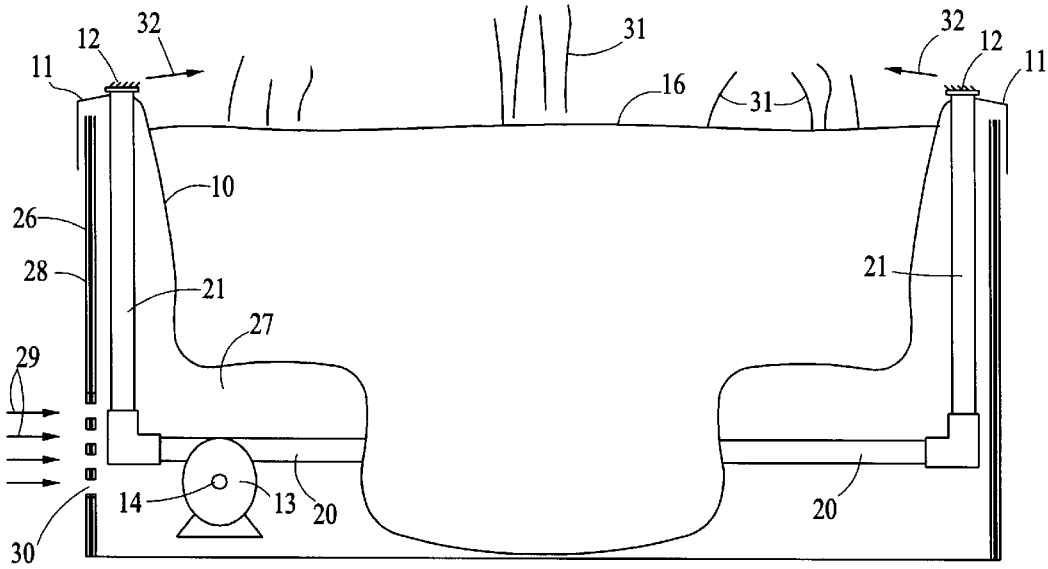
FIG. 3 is a cross-sectional view of a spa contained within a cabinet and having an air blower within the volume of the cabinet directing air to the manifold of FIG. 2.

As shown in FIG. 3, the spa 10 may be contained within a cabinet 26 which creates an interior volume 27 between the inside surface of cabinet 26 and the outside surface 28. It is preferred that the air intake 14 of blower 13 be supplied with a source of outside air 29. This source of outside air is fed to the interior volume 27 through an air duct 30 in the cabinet 26. Other methods can, of course, be provided to accomplish the feeding of outside air to blower 13. One such method would be to run conduit from vent 30 to air inlet 14. Another way is to position the air blower 13 on the exterior of the spa cabinet as shown in FIG. 1 of the drawings. In this way, the air passing into air blower 13 is not contaminated or fed with the vapors 31 emanating from the spa water. In FIG. 3, a flow of outside air 32 is directing the flow of vapors 31 away from louvered directional vents 12. It is preferred that the louvered directional vents 12 be mounted on lip 11, since such a lip is invariably provided around spas and other hot water-containing tubs. As shown in FIG. 5, the louvered directional vent 12 is supplied by cooling air inlet 33 from manifold 20, and more specifically, from the cooling air outlets 21 of manifold 20.

Figure 4:
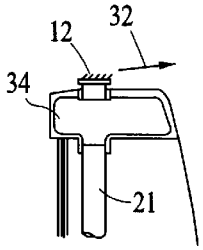
FIG. 4 is a cross-sectional view of the lip of the spa of FIG. 3, showing a manifold formed within the spa interior below the lip of the spa.

While the preferred method of feeding the louvered directional vents 12 is a cooling air channel 21, the cooling air channel 21 may in turn feed a fiberglass channel 54, shown in FIG. 4. Such a channel would pass entirely under the lip 11 of spa 10 and provide a second manifold or a substitute manifold for the distribution of cooling air.

Thus, use of the air blowing assembly of the present invention can eliminate the discomfort caused by the environment of the spa itself. Heating the water in a spa generates an environment high in moisture and humidity mixed with chlorine gas (ozone gas and the like) of sanitizing chemicals. Such an environment surrounds the spa user and can make breathing difficult and uncomfortable. The spa user's face will bead with sweat and the user will often have difficulty breathing the steamy air, causing shortness of breath, fogging up of eyeglasses, and eye irritation. The problem is compounded when the spa is located indoors where there is no natural flow of air to blow away the vapors arising from the spa water. Because the air vents are adjustable, they can be rotated and directed toward the face or body of the user above the spa water level, replacing the hot, humid air with cooler, dryer air.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An air blowing assembly for providing cooling air to the user of a spa, jetted bath tub or other heated-water-containing member of the type having a lip surrounding at least a part of the water-containing member, said assembly comprising:

an air blower having an air blower inlet, an air blower outlet and means for energizing said air blower;

an air-conducting manifold having a manifold air inlet connected to said air blower outlet, said air-conducting manifold having at least one manifold air outlet; and at least one directional vent supported over said lip and said at least one vent having a cooling air inlet and a cooling air outlet, said cooling air outlet including means for aiming the direction of air flow exiting through said cooling air outlet and said cooling air inlet receiving cooling air from said at least one manifold air outlet whereby a spa user can direct cooling air flow towards a face or body above the water level, replacing hot, humid air with cooler, dryer air to alleviate discomfort from an otherwise moist and hot atmosphere.

2. The air blowing assembly of claim 1 wherein said water-containing member is supported within a cabinet having an interior volume and at least one exterior wall and the air blower inlet receives outside air from outside of said at least one exterior wall whereby said air blower moves outside air from outside the cabinet and exhausts said outside air from said at least one directional vent.

3. The air blowing assembly of claim 2 wherein said cabinet completely surrounds said water-containing member and has an outer peripheral surface and said air blower is located outside of said outer peripheral surface.

4. The air blowing assembly of claim 2 wherein said blower is located inside of said interior volume of said cabinet and includes means for receiving outside air at said air blower inlet.

5. The air blowing assembly of claim 2 wherein said air blowing assembly has a plurality of directional vents and said air conducting manifold is contained within said interior volume of said cabinet and has a plurality of manifold air outlets each of said manifold air outlets being connected to a directional vent.

6. The air blowing assembly of claim 5 wherein said plurality of directional vents are louvered directional vents each contain a plurality of louvers to assist in the aiming of an air stream exiting from said louvered directional vents.

7. The air blowing assembly of claim 6 wherein said louvered vents may be moved through a generally horizontal arc about a generally vertical axis.

8. An air blowing assembly for providing cooling air to the user of a spa supported in a cabinet completely surrounding the spa and said cabinet having an interior volume and an outer peripheral surface, said spa having a lip surrounding said spa, said assembly comprising:

an air blower having an air blower inlet, an air blower outlet and means for energizing said air blower;

means for providing outside air to said air blower inlet;

an air-conducting manifold having a manifold air inlet connected to said air blower outlet, said air-conducting manifold having a plurality of manifold air outlets; and a plurality of louvered directional vents supported over said lip and each of said vents having a cooling air inlet and a cooling air outlet, said cooling air outlet including means for aiming the direction of air flow exiting through said cooling air outlet comprising a plurality of adjustable louvers in said cooling air outlet and said cooling air inlet receiving cooling air from one of said plurality of manifold air outlets whereby a spa user can direct the flow of outside air from said cooling air outlet towards a face or body above the water level, replacing hot, humid air with cooler, dryer air to alleviate discomfort from an otherwise moist and hot atmosphere.

* * * * *